US005098508A

United States Patent [19]

Mattil

[11] Patent Number: 5,098,508

[45] Date of Patent: Mar. 24, 1992

[54] WORKBENCH CONSTRUCTION AND METHOD OF ASSEMBLING PARTS ON A WORKBENCH

[75] Inventor: Klaus Mattil, Höheinöd, Fed. Rep. of Germany

[73] Assignee: G.M. Pfaff Aktiengesellschaft, Kaiserslautern, Fed. Rep. of Germany

[21] Appl. No.: 432,225

[22] Filed: Nov. 6, 1989

[30] Foreign Application Priority Data

Nov. 4, 1988 [DE] Fed. Rep. of Germany ..... 3837616

[51] Int. Cl.[5] ..... B32B 31/00

[52] U.S. Cl. ..... 156/363; 156/539; 156/556; 156/578; 156/580; 12/52; 12/61 A; 12/122; 12/123; 12/142 R; 269/21; 269/45

[58] Field of Search ..... 156/578, 583.8, 583.9, 156/583.91, 556, 580, 539, 497, 363; 12/122, 123, 51, 52, 61 R, 61 A, 142 R; 269/45, 21, 239; 112/114, 121.12; 264/46.5, 46.6, 46.7, 46.8

[56] References Cited

U.S. PATENT DOCUMENTS

| | | | |
|---|---|---|---|
| 2,729,195 | 1/1956 | Belz | 12/52 X |
| 3,090,078 | 5/1963 | Ackles | 264/46.5 |
| 3,442,743 | 5/1969 | Schultz et al. | 156/245 |
| 3,945,074 | 3/1976 | Babson et al. | 12/52 |
| 4,090,903 | 5/1978 | Matsui | 156/580 X |
| 4,266,312 | 5/1981 | Hall | 12/52 |
| 4,475,458 | 10/1984 | Kennell et al. | 269/21 X |
| 4,714,035 | 12/1987 | Engle | 269/45 X |
| 4,795,521 | 1/1989 | Leach | 156/578 X |
| 4,863,654 | 9/1989 | Belleville et al. | 264/46.7 X |
| 4,927,479 | 5/1990 | Böck | 156/497 X |

*Primary Examiner*—David A. Simmons
*Assistant Examiner*—J. Sells
*Attorney, Agent, or Firm*—McGlew & Tuttle

[57] ABSTRACT

A workbench is constructed, with which the individual parts of a two-dimensional compound workpiece, for example, a shoe upper, can be assembled accurately without any need for subsequent adjustment operations. The workbench comprises a central, e.g. stationary, bench plate and at least one folding plate hinged onto it, which can be folded over onto the bench plate. At least the folding plate contains holding devices, e.g., in the form of a suction device, with which the individual part located on it can be held in position before and during folding over. The individual parts are adjusted preferably with templates in a mutually adjusted manner before the folding plate is folded over. The workbench can be used in cooperation with an adhesive applying machine.

9 Claims, 3 Drawing Sheets

WORKBENCH CONSTRUCTION AND METHOD OF ASSEMBLING PARTS ON A WORKBENCH

BACKGROUND OF THE INVENTION

This invention relates, in general, to a shoe parts assembly and manufacturing device and, in particular, to a new and useful workbench for assembling parts which must be joined together, for example, by adhesive or by sewing. The invention is also directed to a method of effecting the joining of these parts.

The present invention particularly pertains to a workbench for preparing a two- dimensional compound workpiece comprising both a lower part and at least one upper part placed on it in a predetermined orientation, for example, a shoe upper with a plurality of parts, comprising a bench plate for receiving the lower part.

Parts of shoe uppers are currently still assembled by stitching on conventional sewing machines with manual handling of the upper or its individual parts. Numerically controlled, programmable automatic sewing machines are used only to produce decorative stitchings and in the case of high lot numbers.

Shoe uppers very often comprise a plurality of parts, especially when the shoe uppers are provided with small trimming parts. There are often periods of interruption when stitching such shoe uppers, because the parts of the upper to be connected to one another must constantly be readjusted with respect to one another. This happens especially when the parts to be sewn on, e.g., the above-mentioned trimming parts, are relatively small.

The present invention is based on the consideration that such alignment processes during stitching and the resulting periods of interruption can be almost completely or completely avoided if the parts of the shoe upper are already fixed before stitching, e.g., by gluing. However, this requires that the adhesive be cleanly applied to the individual parts of the shoe upper along defined contours and that the parts of the shoe upper be placed on each other in their final mutual position, without any subsequent alignment being necessary, because such subsequent alignment could cause visible traces of adhesive.

SUMMARY OF THE INVENTION

The present invention provides a workbench, by which accurate assembly of individual two-dimensional parts to a compound workpiece is made possible without any need for subsequent alignment operations.

The workbench according to the present invention makes it possible to align the individual parts to be assembled in a predetermined position first by means of aligning devices on the bench plate and at least one folding plate and subsequently to apply an adhesive, e.g., to predetermined edges, after which the folding plate is folded onto the bench plate, so that the individual part lying on the folding plate is placed onto the individual part lying on the bench plate in a predetermined position. At least the folding plate must be equipped with devices that prevent the individual part located on the folding plate from falling off it while it is being folded over. Such devices can be formed especially by perforations in the folding plate and a suction device, so that the individual part located on the folding plate is fixed on the folding plate by vacuum and can be released from it very simply by breaking the vacuum.

The aligning devices may be templates or fitting pins.

Depending on the number of individual parts to be placed one on top of another, the workbench has a plurality of folding plates. In the simplest case, it is associated with only one folding plate, but there may also be two or more, e.g., a total of six folding plates in the case of a hexagonal bench plate, and the size of said folding plates corresponds to that of the bench plate.

The folding plates can be hinged on the bench plate, with hinges, in a very simple manner. To facilitate the work procedure, the folding plates are preferably associated with mechanical drive means which bring about folding, and an order of folding movements, which depends on the compound workpiece, should preferably be maintained by means of a control device. The folding plates are folded onto the bench plate one after another, the individual parts are released, and the folding plate is folded back again, after which the next folding plate is folded over the compound workpiece that is already partially assembled, etc.

A numerically controlled adhesive applying machine, which applies an adhesive, especially a thermoplastic adhesive, to the individual parts to be connected to each other in predetermine areas, is preferably provided above the workbench.

Accordingly, it is an object of the invention to provide an improved workbench construction for orienting and subsequently joining together parts which are positioned on a workbench and which are then joined to other parts which are carried on a folding plate oriented in respect to the workbench.

A further object of the invention is to provide a method of assembling multi-parts of a shoe which includes positioning at least one of the parts on a workbench to which a folding plate is hinged in a definite relationship, then placing another part on the folding plate and juxtaposing the two parts by folding the plate over the workbench.

A further object of the invention is to provide a method of assembling multi parts of a shoe which includes positioning at least one of the parts on a workbench to which a folding plate is hinged in a definite relationship, then placing another part on the folding plate and juxtaposing the two parts by folding the plate over the workbench.

A further object of the invention is to provide a method of joining parts of an assembly together which may be glued together which comprises orienting a folding plate so that it is hinged to a bench plate in a definite position location, orienting a part to be joined together on both the bench plate and the folding plate and then folding the folding plate relative to the bench plate so as to bring the two plates into juxtaposition and position the parts so that they are in correct alignment for assembly together.

A further object of the invention is to provide a workbench construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
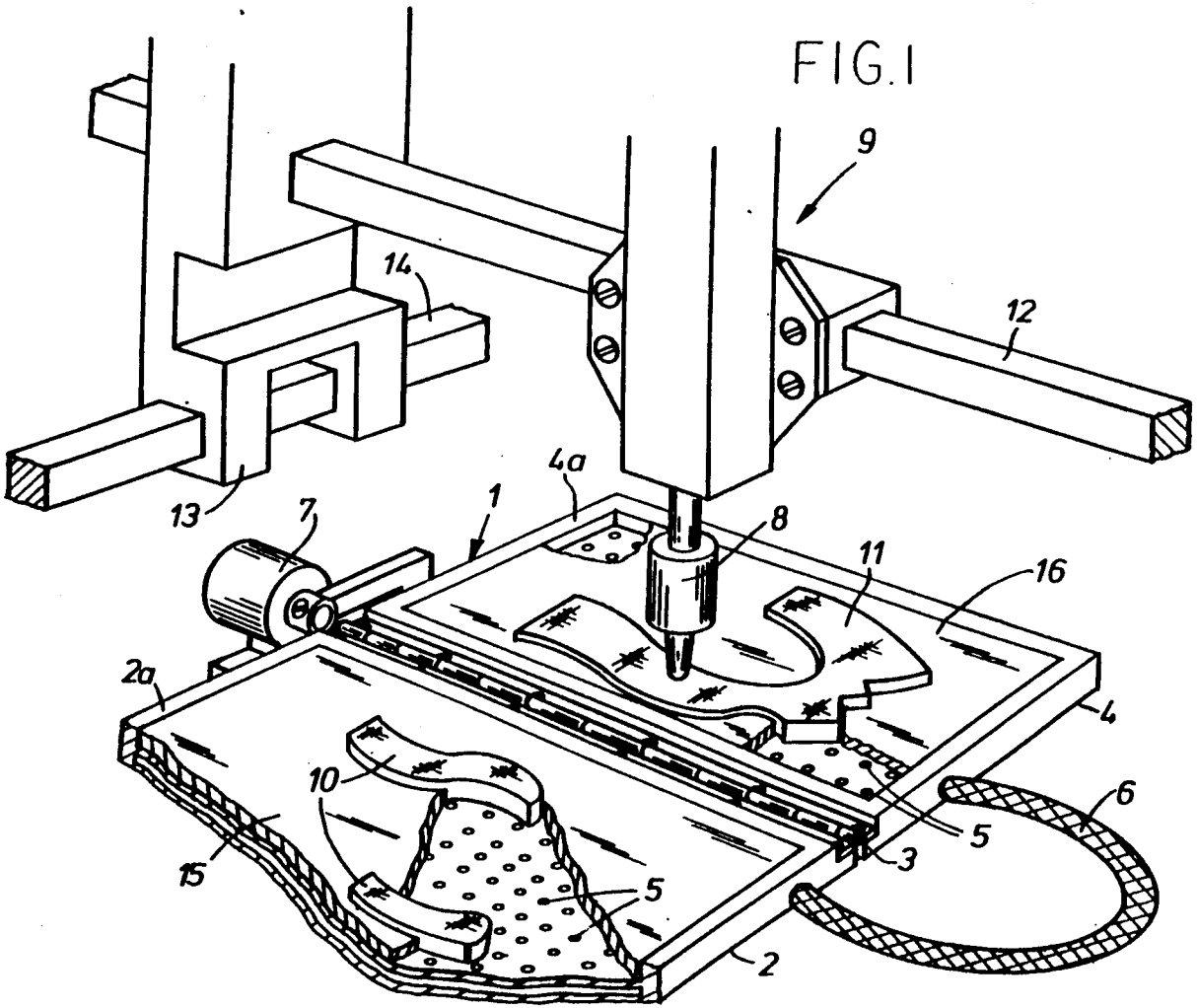
FIG. 1 is a top perspective view of a detail of a workbench according to the present invention with a bench plate, a folding plate, and an adhesive applying machine located above it.

Referring to the drawings, in particular, the invention embodied therein comprises an apparatus and method for assembling parts of an article such as a shoe which includes placing some of these parts or blanks 10 on a bench plate 2 which is hingedly connected to a folding plate 4 in a precise orientation. A part 11 to be joined to the part or parts 10 is placed in a precise position on the folding plate 4 so that it is oriented correctly in respect to the folding plate and the bench plate and the parts thereon. Thereafter, either the parts 10 or the parts 11, or both, are either provided with securing means such as adhesive and then the folding plate 4 is folded over onto the bench plate to align the upper part 11 with the lower parts 10 or the plates 4 and 2 are first juxtaposed and means are provided for sewing through the juxtaposed layers after they are positioned together by folding the two plates.

FIG. 1 shows a workbench designated as a whole by reference numeral 1, comprising the bench plate 2 and the folding plate 4 attached to it with a hinge 3. The folding plate comprises, in this case, a flat, hollow box, which is provided with perforations consisting of a plurality of holes 5 on its top side in the representation shown in FIG. 1. The bench plate 2 preferably also has the same design, i.e., it is provided with perforations, consisting of a plurality of holes. Both plates 2, 4 have flat edge strips 2*a* and 2*b*, respectively, along their side edge. A flexible tube 6 is also seen, which establishes communication between the cavities of the bench plate 2 and the folding plate 4. The cavity of the bench plate 2 is connected to a vacuum source that is not shown here. A swiveling mechanism 7, which, driven by a motor, is able to fold the folding plate 4 from its position shown in FIG. 1 onto the bench plate 2, is fastened both to the bench plate 2 and the folding plate 4.

FIG. 1 also shows the applicator head 8 of an adhesive applying machine, which can be moved above the workbench 1 by means of a cross slide of known type, generally designated 9. It is obvious that the applicator head 8 must be moved out of the way before the folding plate 4 can be folded over onto said bench plate 2.

A series of blanks 10 are arranged on the bench plate 2 in the case described here; the blanks are to be connected as lower parts with another blank 11, which is located on the folding plate 4 in a predetermined position and to which adhesive is currently being applied in the example shown.

The adhesive applicator head 8 can be moved on a rail 12 carrying it on the cross slide 9. The rail 12 is held by a main slide 13 that can be moved on rails, one of which, that designated by reference numeral 14, is shown, at right angles to the direction in which the first rail 12 extends. The drives for moving the adhesive applicator head 8 are not shown for clarity's sake. They represent the state of the art and do not need to be consisting of a plurality of holes. Both plates 2, 4, have flat edge strips 2*a* and 4*a* respectively along their side edge and are preferably numerically controlled.

When working with the workbench 1, the individual parts 10 and 11 that are to be assembled are placed on the bench plate 2 and the folding plate 4 in predetermined positions. The vacuum is subsequently applied with the suction device (not shown) in order to hold these individual parts in their positions. Adhesive, e.g., a rapidly curing hot melt adhesive, is subsequently applied in predetermined areas to the individual part 11 that is to be placed onto the individual parts 10 by means of the adhesive applicator head 8. If the individual parts to be connected to one another are parts of shoe uppers, the adhesive is applied close to the edge zones, where stitches will subsequently be made. Complete coating with adhesive is unacceptable in the case of such parts.

After the adhesive applicator head 8 has been moved aside, i.e., out of the way, the folding plate 4 is folded over onto the bench plate 2 while maintaining the vacuum in the bench plate 2 and the folding plate 4. After the adhesive on the individual part 1 has cured sufficiently to guarantee reliable prebonding of said individual parts 10 and 11, the vacuum is broken, after which the folding plate 4 is folded back into the position shown in FIG. 1. The prebonded, compound workpiece can now be removed from the bench plate 2.

The individual workpiece parts 10 and 11 can be aligned on the bench plate 2 and on the folding plate 4 by means of flat templates 15, 16, respectively which are held on the side by the edge strips 2*a* and 4*a* and are arranged interchangeably on these plates 2 and 4 by means of a noncuring adhesive. This thickness is always smaller than the thickness of the workpiece parts 10, 11 to be aligned, in order to bring these reliably into contact with each other when the folding plate is folded over. In the simplest case, it is also possible to use color markings as aids for adjustment.

Figure 2:
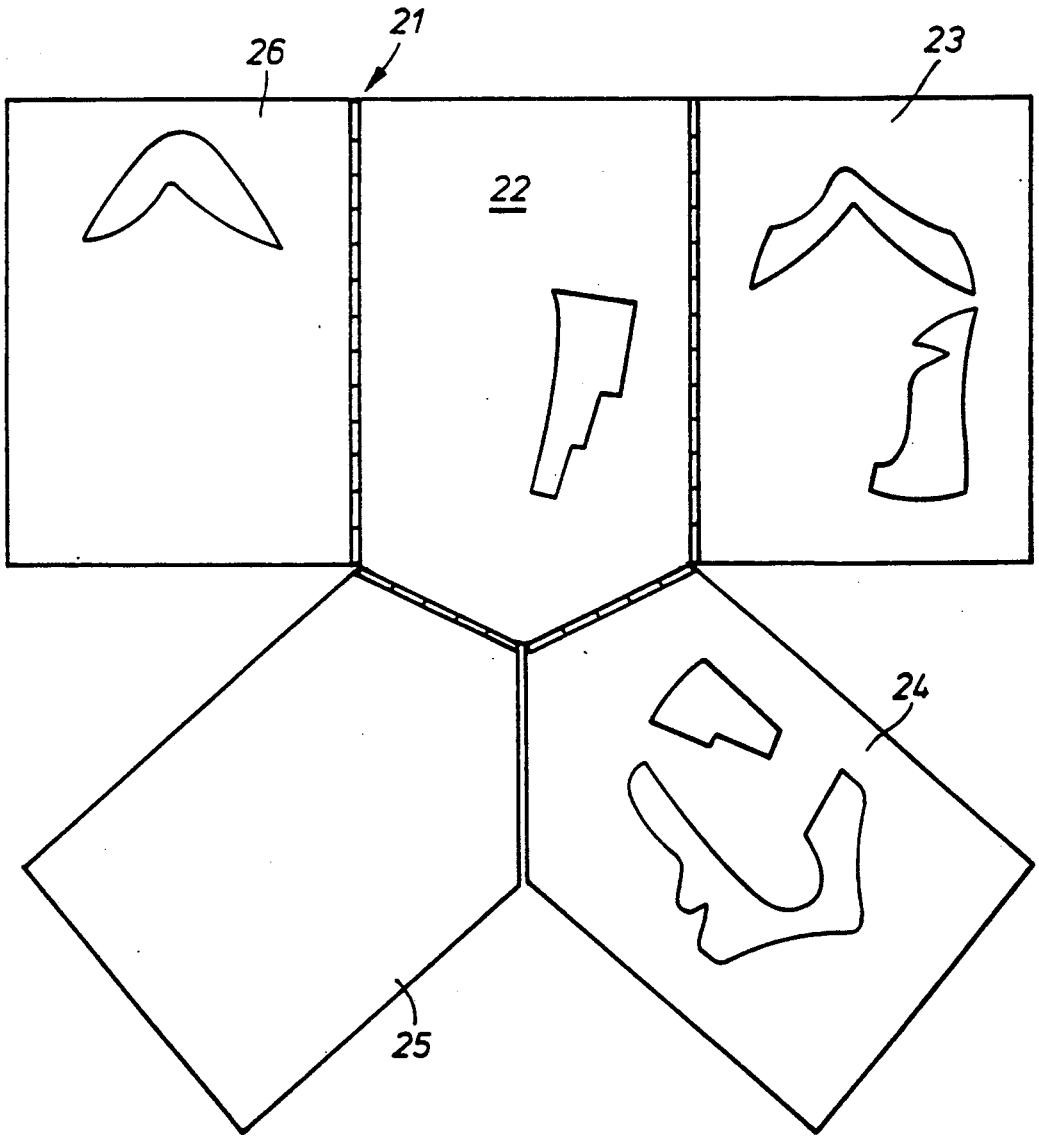
FIG. 2 is a top plan view of another embodiment of a workbench with a bench plate and five folding plates attached to it, with individual parts placed on the folding plates.

FIG. 2 shows an embodiment of the present invention, in which the workbench 21 is of a central bench plate 22 and a total of five folding plates 23, 24, 25, and 26 are hinged onto it. The plates 22–26 are designed, as in the embodiment according to FIG. 1, as suction plates and are connected to a vacuum source (not shown). The central bench plate 22 is essentially rectangular, but one of its short sides has a broken-off edge, so that the bench plate 22 is actually pentagonal. The folding plates 23 and 26 are hinged onto the two long sides, while the folding plates 24 and 25 are hinged onto said broken-off short side. The latter folding plates are not connected to each other, so that they can be folded over onto the bench plate 22 one by one. The dimensions and the shapes of said folding plates 23 through 26 are always such that they are able to completely cover the central bench plate 22 or at least a portion of the bench plate.

The example of FIG. 2 shows a plurality of individual parts, which are parts of a shoe upper that is to be prebonded by means of the workbench. To do so, the folding plate 23 is first folded over on top of the central bench plate 22, and then, after the folding plate 23 had been folded back, the folding plate 24 is folded over onto the bench plate 22, and the folding plate 26 is folded over onto the bench plate 22 after the folding plate 24 had been folded back. The sequence can, of course, be modified, depending on the nature of the product to be manufactured. The folding plate 25 is skipped in this example.

As in the work process described on the basis of FIG. 1, the individual parts are previously provided with adhesive in appropriate areas by means of an adhesive applying machine as shown in FIG. 1.

Figure 3:
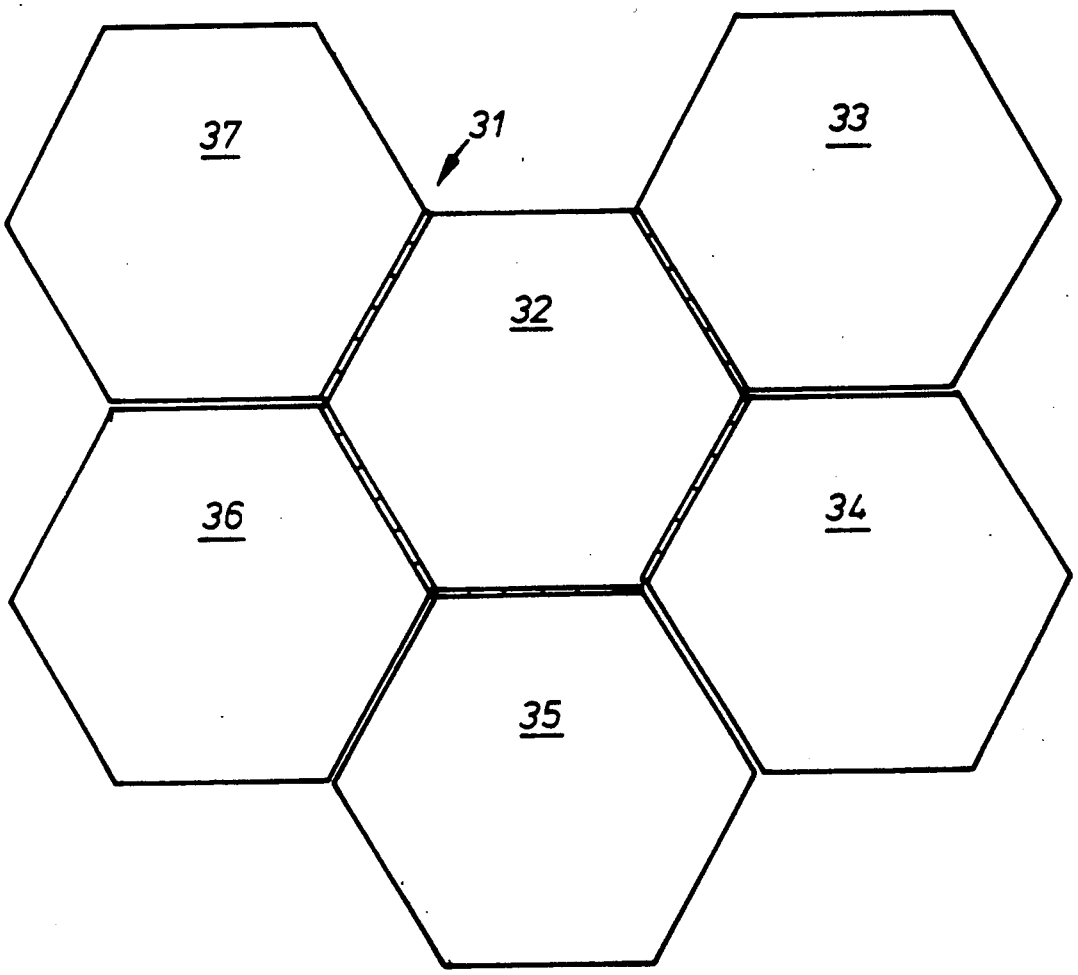
FIG. 3 is a top view of another embodiment of workbench with a hexagonal bench plate with five folding plates attached to it.

FIG. 3 shows a workbench 31, in which the central bench plate 32 has a hexagonal shape, and hexagonal folding plates 33–37 are hinged at five edges of said central bench plate 32, and the plates 32–37 are also designed as suction plates.

As is apparent from FIGS. 2 and 3, one of the edges of the central bench plate 22 or 32 has no folding plate in order to provide easier access to the central bench plate for placing individual parts or a compound workpiece on it and for removing them. In the embodiments according to FIGS. 2 and 3, it is also possible to use comparable devices for holding the folding plates at the central bench plate and comparable mechanical drive means for swiveling the folding plates.

If, as in FIGS. 2 and 3, a plurality of folding plates are attached to one bench plate, it is advantageous to provide for separate control of the vacuum in the individual folding plates for holding the individual parts on the surfaces of the folding plates in order for the individual parts to be able to be held and released at the individually appropriate times.

Even though it is possible, in principle, to perform multistep assembly processes with a workbench having only one folding plate, as is shown in FIG. 1, by placing the parts to be prebonded to one another on the folding plate one after another and transferring the parts onto the individual part located on the bench plate, the workbenches 21, 31 according to FIGS. 2 and 3 do offer the advantage that, if desired, all the individual parts, which are to be assembled into a compound workpiece, can be prepared together in order to increase the pace of work and to make the adhesive application process more efficient.

While specific embodiments of the invention have been shown and described in detail to illustrate the application of the principles of the invention, it will be understood that the invention may be embodied otherwise without departing from such principles.

What is claimed is:

1. A workbench for combining shoe workpiece parts into a multilayer composite workpiece comprising: a bench plate having at least one hinged edge, orientation means on said bench plate for orienting a first shoe part to be assembled in a selected orientation, at least one positioning plate, said positioning plate being connected to said hinged edge of said bench plate by hinge means for tilting said positioning plate relative to said bench plate between a substantially horizontal loading position and a transfer position, turned through substantially 180° from said loading position, positioning plate orientation means on said positioning plate for orienting a second shoe part on said positioning plate in a selected position in respect to said positioning plate, holding means connected to said positioning plate for holding said second shoe part on said positioning plate, adhesive application means for applying adhesive to a shoe part positioned on one of said bench plate and positioning plate, and a driving pivoting means responsive to a completion of adhesive application by said adhesive application means and for activating a pivoting mechanism, said pivoting mechanism being connected between said bench plate and said positioning plate for positioning said positioning plate relative to said bench plate about said hinged edge for pivoting the folding plate into the transfer position.

2. A workbench according to claim 1, wherein said bench plate is rectangular and a first positioning plate is associated with an edge of the bench plate and a second positioning plate is associated with another edge of the bench plate said first and second positioning plates being formed shaped substantially the same as said bench plate.

3. A workbench in accordance with claim 1, wherein said bench plate has two mutually parallel edges at right angles thereto forming a pentagonal support surface together with the other edges, one positioning plate being associated with said first and second edges and two individually positionable positioning plates being associated with said broken-off edge said positioning plates being formed shaped substantially the same as said bench plate.

4. A workbench according to claim 1, wherein said bench plate is hexagonal and a positioning plate is hingedly connected to each of five edges of said hexagonal bench plate, said positioning plate being formed shaped substantially the same as said bench plate.

5. A workpiece according to claim 1, wherein said bench plate is hexagonal and has five edges with a hinge connection thereon, and a positioning plate is connected to each hinge of each edge, said positioning plates being hexagonal.

6. A workbench according to claim 1, wherein means for orienting said parts on said bench plate comprise templates, said templates being interchangeably fastened to said bench plate and said folding plate.

7. A workbench according to claim 1, wherein said holding means includes perforations provided in said folding plate and including suction means connected to said perforations for holding a part thereto.

8. A workpiece orienting workbench, comprising: a bench plate having a hinge edge; orientation means on said bench plate for orienting a first workpiece part in a selected orientation; a positioning plate connected to said hinge edge of said bench plate by hinge means for tilting said positioning plate relative to said bench plate between a substantially horizontal loading position and a transfer position, turned through substantially 180° from said loading position; positioning plate orientation means on said positioning plate for orienting a second workpiece part on said positioning plate; holding means connected to said positioning plate for holding said second workpiece part on said positioning plate; adhesive application means for applying adhesive to a workpiece part positioned on one of said bench plate and positioning plate and driving means activated in response to an application of adhesive by said adhesive application means for moving said positioning plate between said loading position and said transfer position.

9. A workbench according to claim 1, including means to move said folding plate about its hinge connection to said bench plate into juxtaposition with said bench plate to join said second part with said first part.

* * * * *